US008382388B2

(12) United States Patent
Iwasaki

(10) Patent No.: US 8,382,388 B2
(45) Date of Patent: Feb. 26, 2013

(54) THERMAL PRINTER AND DRIVE CONTROL METHOD OF THERMAL HEAD

(75) Inventor: Fumiharu Iwasaki, Sunto-gun (JP)

(73) Assignees: Toshiba Tec Kabushiki Kaisha, Tokyo (JP); NCR Corporation, Dayton, OH (US)

( * ) Notice: Subject to any disclaimer, the term of this patent is extended or adjusted under 35 U.S.C. 154(b) by 510 days.

(21) Appl. No.: 12/696,240

(22) Filed: Jan. 29, 2010

(65) Prior Publication Data

US 2010/0134580 A1 Jun. 3, 2010

Related U.S. Application Data

(62) Division of application No. 11/681,928, filed on Mar. 5, 2007, now Pat. No. 7,950,860.

(30) Foreign Application Priority Data

May 30, 2006 (JP) ..... 2006-150501
May 30, 2006 (JP) ..... 2006-150502

(51) Int. Cl.
*B41J 3/54* (2006.01)
*B41J 2/355* (2006.01)

(52) U.S. Cl. ..... 400/120.01; 400/149; 400/188; 400/120.05; 347/180; 347/218; 347/211

(58) Field of Classification Search ..... 347/190, 347/192, 211, 180, 181, 182, 218; 400/120.05, 400/120.06, 120.01, 149, 188
See application file for complete search history.

(56) References Cited

U.S. PATENT DOCUMENTS 5,717,837 A 2/1998 Asai et al.
6,118,469 A 9/2000 Hosomi
6,120,198 A 9/2000 Sawano et al.
6,759,366 B2 7/2004 Beckerdite et al.
6,784,906 B2 8/2004 Long et al.

FOREIGN PATENT DOCUMENTS

| | | |
|---|---|---|
| EP | 0947340 | 10/1999 |
| JP | 57-201674 | 12/1982 |
| JP | 58-008668 | 1/1983 |
| JP | 61-003765 | 1/1986 |
| JP | 01-063168 | 3/1989 |
| JP | 64-063168 | 3/1989 |
| JP | 03-051149 | 3/1991 |
| JP | 03-234560 | 10/1991 |
| JP | 06-024082 | 2/1994 |
| JP | 06047946 A | 6/1994 |
| JP | 09-233256 | 9/1997 |
| JP | 10-076713 | 3/1998 |
| JP | 10-138572 | 5/1998 |
| JP | 11-286147 | 10/1999 |

(Continued)

OTHER PUBLICATIONS

OA dated Sep. 17, 2010 for U.S. Appl. No. 11/681,928, 13 pages.

(Continued)

*Primary Examiner* — Leslie J Evanisko
(74) *Attorney, Agent, or Firm* — Turocy & Watson, LLP

(57) ABSTRACT

A thermal printer includes a first thermal head which is so provided as to be brought into contact with one side of a paper, a second thermal head which is so provided as to be brought into contact with the other side of the paper, and a controller. The first thermal head energizes a plurality of heater elements to print dot image data on one side of the paper. The second thermal head energizes a plurality of heater elements to print dot image data on the other side of the paper. The controller is configured to shift the energization times between the first thermal head and second thermal head.

6 Claims, 12 Drawing Sheets

FOREIGN PATENT DOCUMENTS

| | | |
|---|---|---|
| JP | 2001-199095 | 7/2001 |
| JP | 2003-127451 | 5/2003 |
| JP | 2003136773 A | 5/2003 |

OTHER PUBLICATIONS

OA dated Apr. 5, 2010 for U.S. Appl. No. 11/681,928, 44 pages.
Japanese Office Action dated Apr. 4, 2008 corresponding to U.S. Appl. No. 11/681,928, filed Mar. 5, 2007.
European Search Report for EP 07 10 8848 dated May 8, 2008 corresponding to U.S. Appl. No. 11/681,928, filed Mar. 5, 2007.
Japanese Office Action dated Jun. 10, 2008 corresponding to U.S. Appl. No. 11/681,928, filed Mar. 5, 2007.
Chinese Office Action dated Jan. 16, 2009 corresponding to U.S. Appl. No. 11/681,928, filed Mar. 5, 2007.
OA dated May 24, 2012 for U.S. Appl. No. 12/696,231, 24 pages.
Office Action dated Oct. 4, 2012 for U.S. Appl. No. 12/696,231, 22 pages.

THERMAL PRINTER AND DRIVE CONTROL METHOD OF THERMAL HEAD

CROSS-REFERENCE TO RELATED APPLICATIONS

This application is a Divisional of application Ser. No. 11/681,928 filed Mar. 5, 2007 now U.S. Pat. No. 7,950,860, patented May 31, 2011, the entire contents of which is hereby incorporated by reference.

This application is based upon and claims the benefit of priority from prior Japanese Patent Applications No. 2006-150501, filed May 30, 2006; and No. 2006-150502, filed May 30, 2006, the entire contents of both of which are incorporated herein by reference.

BACKGROUND OF THE INVENTION

1. Field of the Invention

The present invention relates to a thermal printer capable of printing images simultaneously on both sides of a printing medium and a drive control method of a thermal head of the thermal printer.

2. Description of the Related Art

A thermal printer capable of printing images simultaneously on both sides of a thermal paper is disclosed in Jpn. Pat. Appln. Publication No. 11-286147. This printer has two platen rollers and two thermal heads.

In this thermal printer, first and second platen rollers are rotated in synchronization with each other and at the same paper-feeding speed. The thermal paper is passed between the first platen roller and first thermal head and thereby images are printed on one side of the thermal paper by the first thermal head. The same thermal paper is then passed between the second platen roller and second thermal head and thereby images are printed on the other side of the thermal paper by the second thermal head.

As a print head used in this thermal printer, there is known a line thermal head in which a large number of heater elements are arranged in a line in the direction perpendicular to the feeding direction of the thermal paper. When a current is applied to the heater elements corresponding to recording pixels, that is, electric energy is applied, the energized heater elements generate heat. As a result, an arbitrary dot pattern is printed on the thermal paper.

BRIEF SUMMARY OF THE INVENTION

In the case of a thermal printer having two thermal heads, when a current is applied to both the thermal heads simultaneously, the peak value of energy (current) consumption becomes large. This requires a corresponding power source, preventing reduction in price and size.

In the following embodiments of the present invention, a thermal printer includes a first thermal head, which is so provided as to be brought into contact with one side of a paper, a second thermal head, which is so provided as to be brought into contact with the other side of the paper, and a controller. The first thermal head energizes a plurality of heater elements to print dot image data on one side of the paper. The second thermal head energizes a plurality of heater elements to print dot image data on the other side of the paper. The controller is configured to shift the energization time between the first thermal head and second thermal head.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Preferred embodiments of the present invention will be described below with reference to the accompanying drawings. The following embodiments explain a case where the present invention is applied to a thermal printer 10 which performs printing of images on the front and back sides of a thermal paper 1 having a heat-sensitive layer respectively on the both sides thereof.

First Embodiment

Firstly, a first embodiment of the present invention will be described, in which thermal head energization time required for printing of one-dot line data is controlled.

Figure 1:
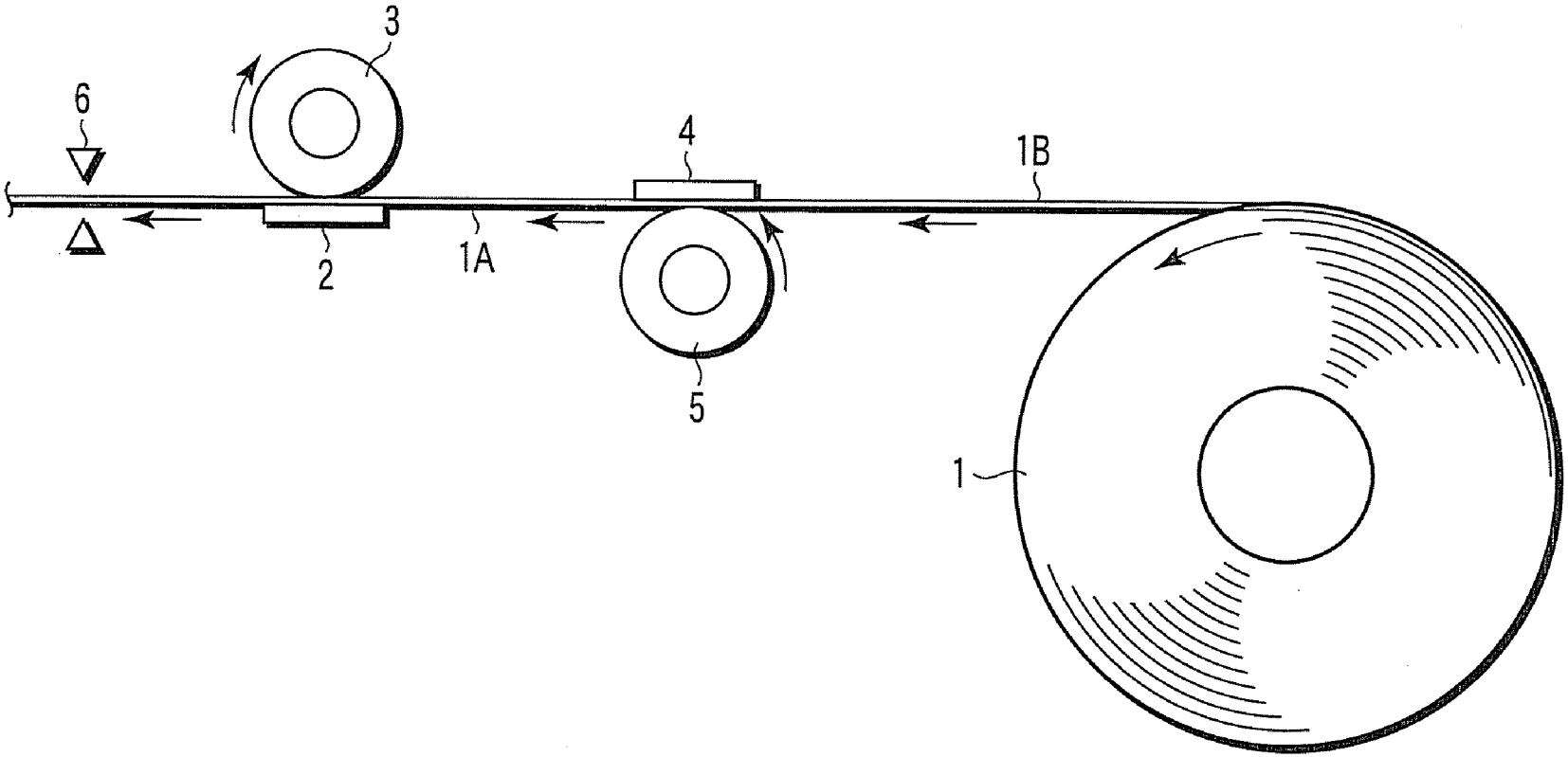
FIG. 1 is a view schematically showing a print mechanism section of a thermal printer according to an embodiment of the present invention.

FIG. 1 schematically shows a print mechanism section of the thermal printer 10. The thermal paper 1 wound in a roll is housed in a not shown paper housing section of a printer main body. The leading end of the thermal paper 1 is drawn from the paper housing section along a paper feeding path and discharged to outside through a paper outlet.

First and second thermal heads 2 and 4 are provided along the paper feeding path. The second thermal head 4 is located on the paper housing section side relative to the first thermal head 2.

The first thermal head 2 is so provided as to be brought into contact with one side (hereinafter, referred to as "front side 1A") of the thermal paper 1. A first platen roller 3 is so provided as to be opposed to the first thermal head 2 across the thermal paper 1.

The second thermal head 4 is so provided as to be brought into contact with the other side (hereinafter, referred to as "back side 1B") of the thermal paper 1. A second platen roller 5 is so provided as to be opposed to the second thermal head 4 across the thermal paper 1.

A cutter mechanism 6 for cutting off the thermal paper 1 is provided immediately on the upstream side of the paper outlet.

A heat-sensitive layer is formed respectively on the front and back sides 1A and 1B of the thermal paper 1. The heat-sensitive layer is formed of a material which develops a desired color such as black or red when heated up to a predetermined temperature. The thermal paper 1 is wound in a roll such that the front side 1A faces inward.

The first thermal head 2 and second thermal head 4 each are a line thermal head in which a large number of heater elements are arranged in a line, and they are attached to the printer main body such that the arrangement direction of the heater elements crosses at right angles the feeding direction of the thermal paper 1.

The first platen roller 3 and second platen roller 5 are each formed in a cylindrical shape. When receiving a rotation of a feed motor 23 (to be described later) by a not shown power transfer mechanism, the first and second platen rollers 3 and 5 are rotated in the directions denoted by arrows of FIG. 1, respectively. The rotations of the platen rollers 3 and 5 feed the thermal paper 1 drawn from the paper housing section in the direction of the arrow of FIG. 1 and discharged to outside through the paper outlet.

Figure 2:
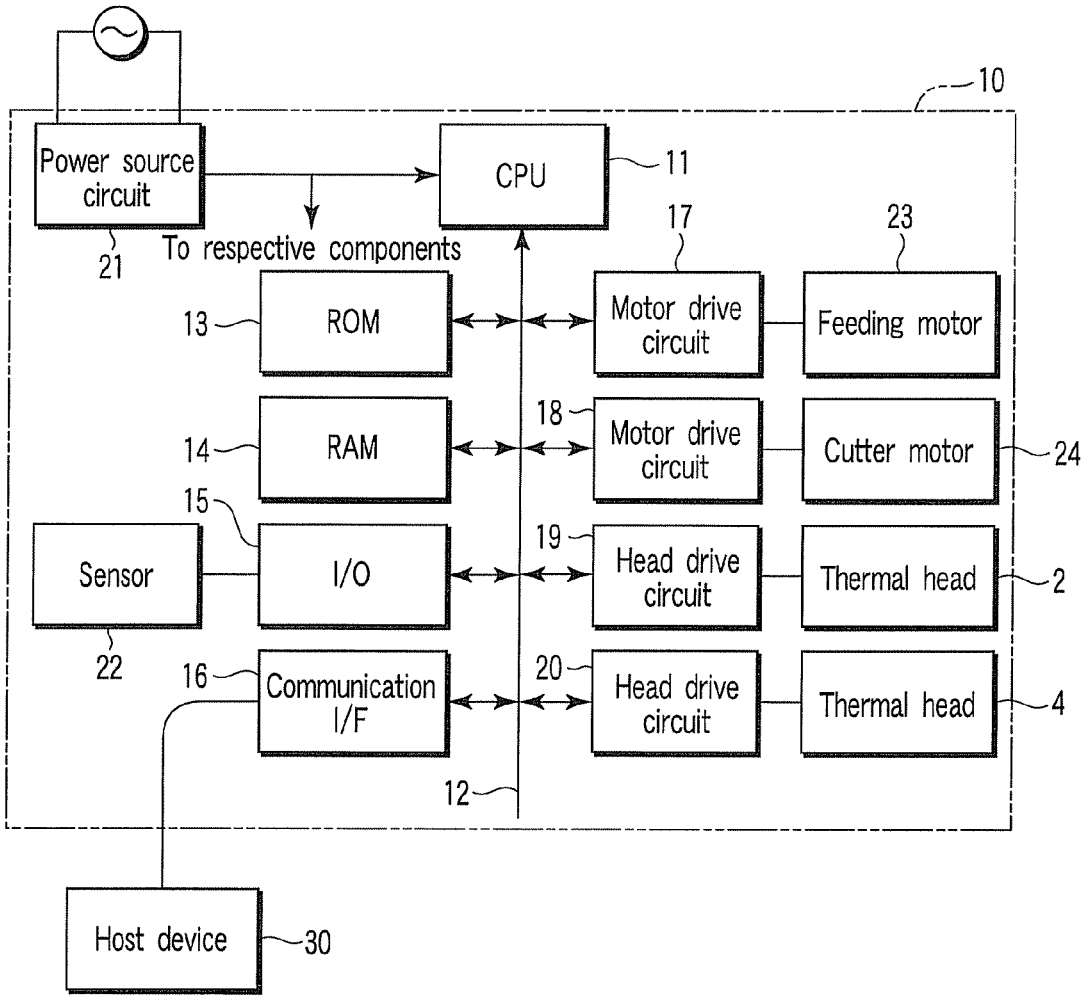
FIG. 2 is a block diagram showing a configuration of the main part of the thermal printer.

FIG. 2 is a block diagram showing a configuration of the main part of the thermal printer 10. The thermal printer 10 includes, as a controller main body, a CPU (Central Processing Unit) 11. A ROM (Read Only Memory) 13, a RAM (Random Access Memory) 14, an I/O (Input/Output) port 15, a communication interface 16, first and second motor drive circuits 17 and 18, and first and second head drive circuits 19 and 20 are connected to the CPU 11 through a bus line 12 such as an address bus, data bus, or the like. A drive current is supplied to the CPU 11 and the above components from a power source circuit 21.

A host device 30 for generating print data is connected to the communication interface 16. Signals from various sensors 22, which are provided in the printer main body, are input to the I/O port 15.

The first motor drive circuit 17 controls on/off of the feed motor 23 serving as a drive source of a paper feeding mechanism. The second motor drive circuit 18 controls on/off of a cutter motor 24 serving as a drive source of the cutter mechanism 6.

The first head drive circuit 19 drives the first thermal head 2. The second head drive circuit 20 drives the second thermal head 4.

Figure 3:
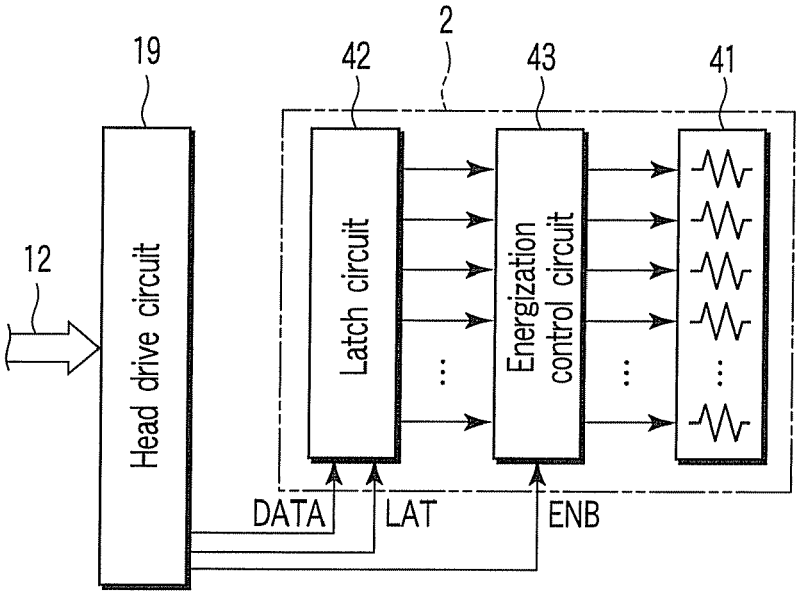
FIG. 3 is a block diagram showing a configuration of the main part of a thermal head provided in the thermal printer.

A correspondence between the first head drive circuit 19 and first thermal head 2 will be described using a block diagram of FIG. 3. Note that a correspondence between the second head drive circuit 20 and second thermal head 4 is the same, and description thereof will be omitted here.

The first thermal head 2 is constituted by a line thermal head main body 41 in which N heater elements are arranged in a line, a latch circuit 42 having a first-in-first-out function, and an energization control circuit 43. The head main body 41 is configured to print one-line data composed of N dots at a time. The latch circuit 42 latches the one-line data for each line. The energization control circuit 43 selectively energizes the heater elements of the head main body 41 in accordance with the one-line data latched by the latch circuit 42.

The first head drive circuit 19 outputs a serial data signal DATA and a latch signal LAT to the latch circuit 42 and outputs an enable signal ENB to the energization control circuit 43 every time it loads one-line data corresponding to N dots through the bus line 12.

The latch circuit 42 latches one-line data output from the head drive circuit 19 at the timing at which the latch signal LAT becomes active. The energization control circuit 43 selectively energizes the heater elements corresponding to the print dots of the one-line data latched by the latch circuit 42 while the enable signal ENB is active.

Figure 4:
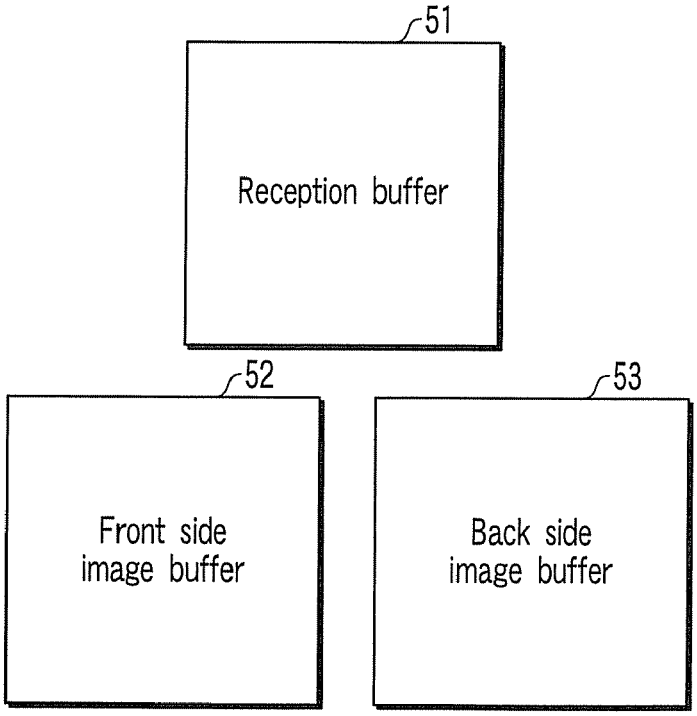
FIG. 4 is a view showing a main memory area allocated in a RAM provided in the thermal printer.

As shown in FIG. 4, the thermal printer 10 includes a reception buffer 51, a front side image buffer 52, and a back side image buffer 53. The reception buffer 51 receives print data from the host device 30 and temporarily stores the print data. In the front side image buffer 52, dot image data of print data to be printed on the front side 1A of the thermal paper 1 is developed and stored. In the back side image buffer 53, dot image data of print data to be printed on the back side 1B of the thermal paper 1 is developed and stored. The above buffers 51, 52, and 53 are allocated in the RAM 14.

Figure 5:
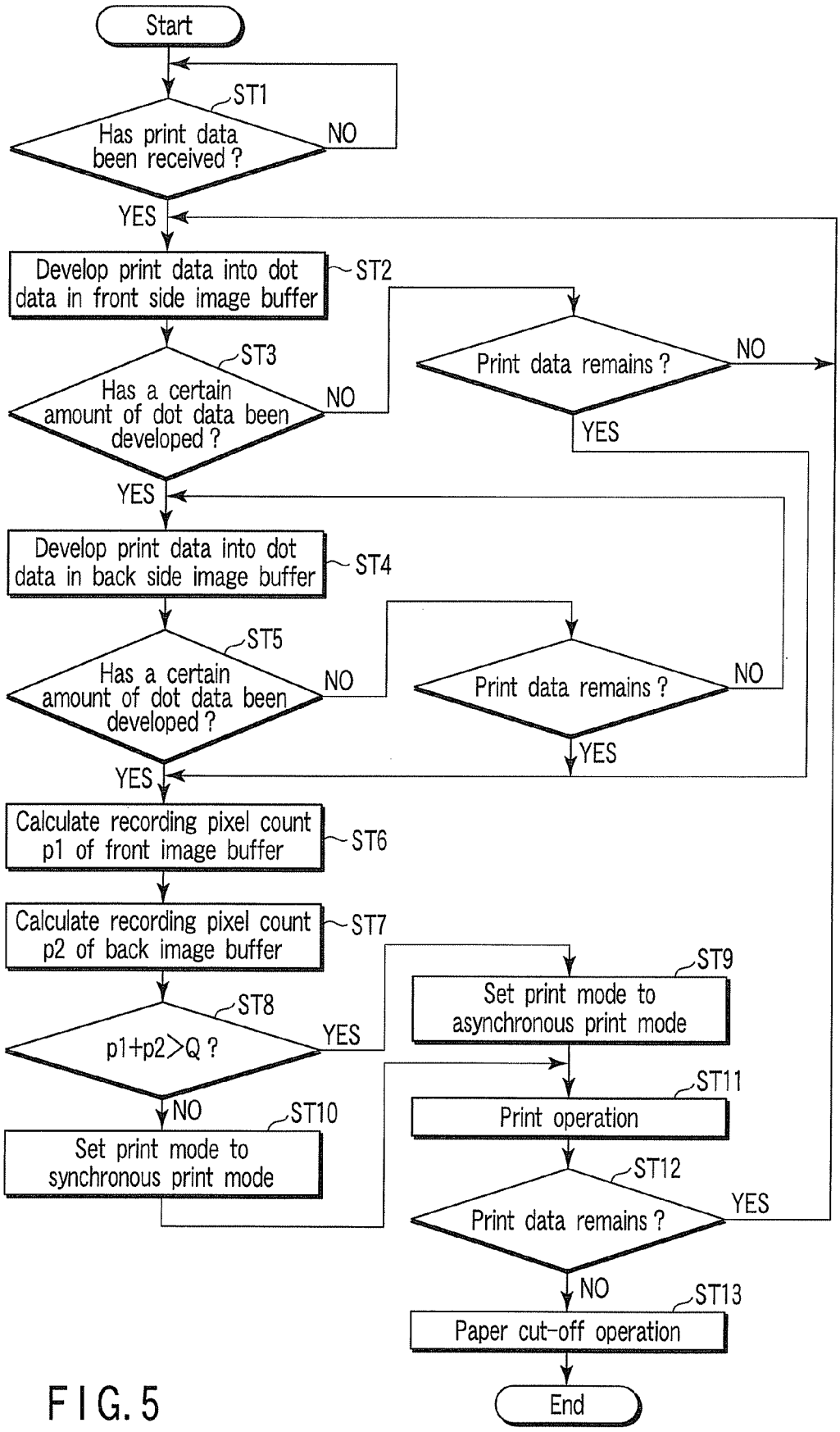
FIG. 5 is a flowchart showing a control procedure executed by a CPU of the thermal printer in the first embodiment of the present invention.

The CPU 11 controls double-sided printing on the thermal paper 1 according to the procedure of steps ST1 through ST13 of the flowchart shown in FIG. 5.

In step ST1, the CPU 11 waits for reception of print data. Upon receiving the print data from the host device 30, the CPU 11 stores the print data in the reception buffer 51. In step ST2, the CPU 11 sequentially develops the print data in the reception buffer 51 into dot data, starting from the head of the print data. The dot data is then stored in the front side image buffer 52.

In step ST3, the CPU 11 determines whether a certain amount of dot data has been stored in the front side image buffer 52. When a certain amount of dot data has been stored, the CPU advances to step ST4.

In step ST4, the CPU 11 sequentially develops residual print data in the reception buffer 51 into dot data. The developed dot data is stored in the back side image buffer 53.

In step ST5, the CPU 11 determines whether a certain amount of dot data has been stored in the back side image buffer 53. When a certain amount of dot data has been stored, the CPU 11 advances to step ST6.

Also in the case where all the print data in the reception buffer 51 has been developed into the dot data before a certain amount of dot data has been stored in the front side image buffer 52 or back side image buffer 53, the CPU 11 advances to step ST6.

In step ST6, the CPU 11 counts the number of print dots of the dot data stored in the front side image buffer 52. The number of dots is then stored as front side recording pixel count p1.

In step ST7, the CPU 11 counts the number of print dots of the dot data stored in the back side image buffer 53. The number of dots is then stored as back side recording pixel count p2.

In step ST8, the CPU 11 adds front side recording pixel count p1 and back side recording pixel count p2 and then determines whether the summation (p1+p2) exceeds a preset threshold value Q. The threshold value Q is an arbitrary value set based on the specification of the power source circuit 21.

In the case where the summation (p1+p2) exceeds the threshold value Q as a result of the comparison, the CPU 11 advances to step ST9. In step ST9, the CPU 11 sets the print mode to an asynchronous print mode.

In the case where the summation (p1+p2) does not exceed the threshold value Q, the CPU 11 advances to step ST10. In step ST10, the CPU 11 sets the print mode to a synchronous print mode.

After the setting of the print mode, the CPU 11 advances to step ST11. In step ST11, the CPU 11 controls double-sided printing according to the set print mode. That is, the CPU 11 supplies the dot data stored in the front side image buffer 52 to the first thermal head 2 in units of lines to allow the thermal head 2 to print the dot data on the front side 1A of the thermal paper 1. At the same time, the CPU 11 supplies the dot data stored in the back side image buffer 53 to the second thermal head 4 in units of lines to allow the thermal head 4 to print the dot data on the back side 1B of the thermal paper 1.

After completion of the printing of the dot data stored in the front side image buffer 52 and back side image buffer 53, the CPU 11 advances to step ST12. In step ST12, the CPU 11 determines whether any print data remains in the reception buffer 51.

In the case where there remains any print data, the CPU 11 executes the processes of steps ST2 through ST12 once again. In the case where there remains no print data, the CPU 11 advances to step ST13.

In step ST13, the CPU 11 performs long feeding of the thermal paper 1 and then outputs a drive signal to the cutter motor 24. The output of the drive signal causes the cutter motor 24 to activate the cutter mechanism 6, thereby cutting the thermal paper. Then, the control for the received print data is completed.

Figure 6:
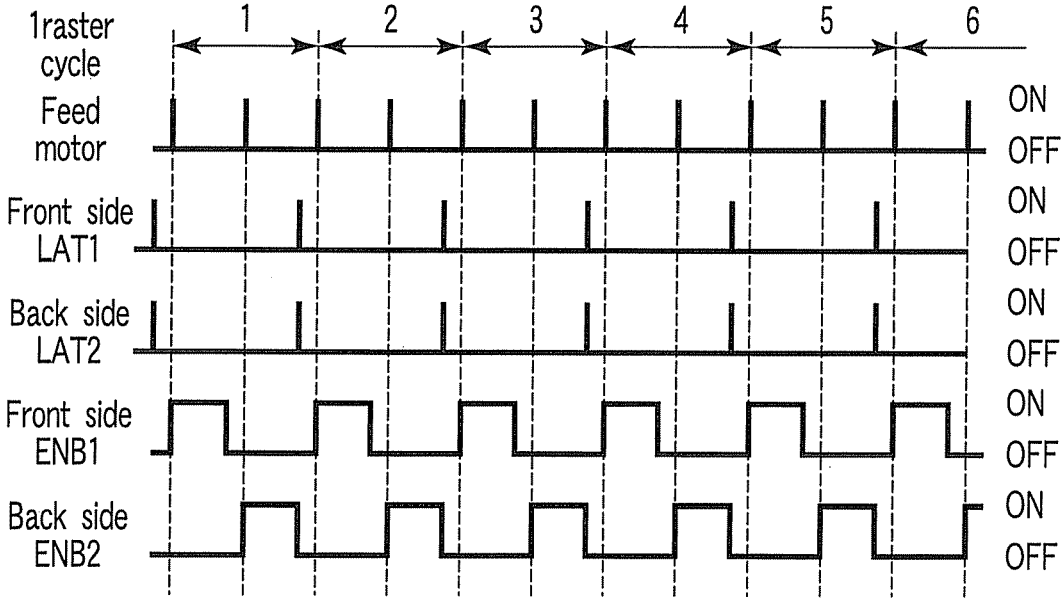
FIG. 6 is a view showing an example of timing of main signals obtained in the case where the asynchronous print mode is set as the print mode in the first embodiment.

FIG. 6 is a timing chart of main signals obtained in the case where the asynchronous print mode is set. FIG. 6 shows, from above, a cycle (raster cycle) required for printing of one dot-line data, a drive pulse signal for the feed motor 23, a latch signal LAT1 for the first thermal head 2, a latch signal LAT2 for the second thermal head 4, an enable signal ENB1 for the first thermal head 2, and an enable signal ENB2 for the second thermal head 4.

As shown in FIG. 6, in the case where the asynchronous print mode is set, a drive pulse signal is output at a ½ cycle of one raster cycle. The latch signals LAT1 and LAT2 are output at the same cycle of one raster cycle. The enable signal ENB1 is output in synchronization with the first half pulse signal of the drive pulse signal. The enable signal ENB2 is output in synchronization with the second half pulse signal of the drive pulse signal.

The pulse widths of the enable signals ENB1 and ENB2, that is, the energization time required for printing of the one dot-line data are set shorter than ½ of the time length of one raster cycle. In other words, one raster cycle is set more than double the energization time required for printing of the one dot-line data.

Figure 8:
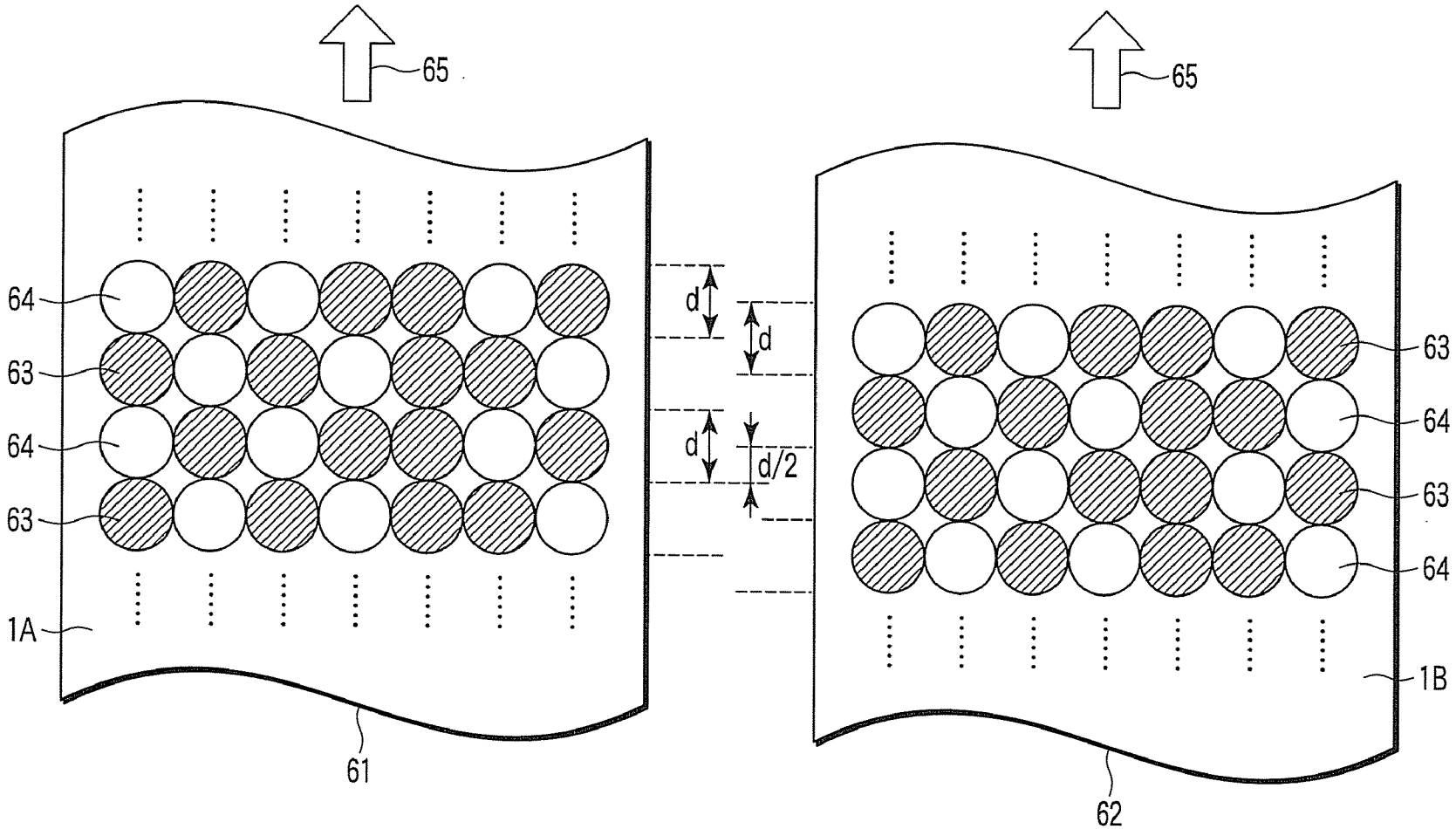
FIG. 8 is a view showing an example of dot printing obtained in the case where the asynchronous print mode is set as the print mode in the first embodiment.

FIG. 8 shows an example of dot printing obtained in the case where the asynchronous print mode is set. In FIG. 8, the left side shows a printing example 61 on the front side 1A printed by the first thermal head 2, and the right side shows a printing example 62 on the back side 1B printed by the second thermal head 4. A black dot 63 denotes a print dot and a white dot 64 denotes a non-print dot. The feeding direction of the thermal paper 1 is denoted by an arrow 65. An interval d denotes the dot length of the print dot 63 in the feeding direction 65.

The first thermal head 2 energizes the heater elements corresponding to the print dots 63 of the one-line data (N dots data) latched by the latch circuit 42 at the timing at which the latch signal LAT1 is turned on while the enable signal ENB1 is on. As a result, the print dots 63 (each dot length=d) corresponding to one line are printed on the front side 1A of the thermal paper 1 in the direction perpendicular to the paper feeding direction 65.

The second thermal head 4 energizes the heater elements corresponding to the print dots 63 of the one-line data (N dots data) latched by the latch circuit 42 at the timing at which the latch signal LAT2 is turned on while the enable signal ENB2 is on. As a result, the print dots 63 (each dot length=d) corresponding to one line are printed on the back side 1B of the thermal paper 1 in the direction perpendicular to the paper feeding direction 65.

The feed motor 23 is turned on in synchronization with the output timing of the enable signal ENB1 and output timing of enable signal ENB2, respectively. Every time the feed motor 23 is turned on, the thermal paper 1 is fed in one direction. Since the drive pulse signal for the feed motor 23 is output at a ½ cycle of one raster cycle, the paper feeding amount is half (d/2) the dot length d of the print dot 63 in the paper feeding direction 65.

Accordingly, as shown in FIG. 8, the position of the one-line data printed on the front side 1A of the thermal paper 1 and one-line data printed on the back side 1B thereof are displaced by half of the dot length (d/2).

As described above, in the case where the asynchronous print mode is set, the time during which the enable signal ENB1 is active and time during which the enable signal ENB2 is active do not overlap each other. Specifically, the energization cycles of the first thermal head 2 and second thermal head 4 are respectively set more than double the energization time required for printing of the one dot-line data, and the energization cycle is shifted by substantially a ½ cycle between the first and second thermal heads 2 and 4.

Therefore, two thermal heads 2 and 4 are not energized at the same time, with the result that the peak value of the required current at the thermal head energization time becomes a low value, which substantially corresponds to a value obtained in the case of a one-sided thermal printer having only one thermal head.

Figure 7:
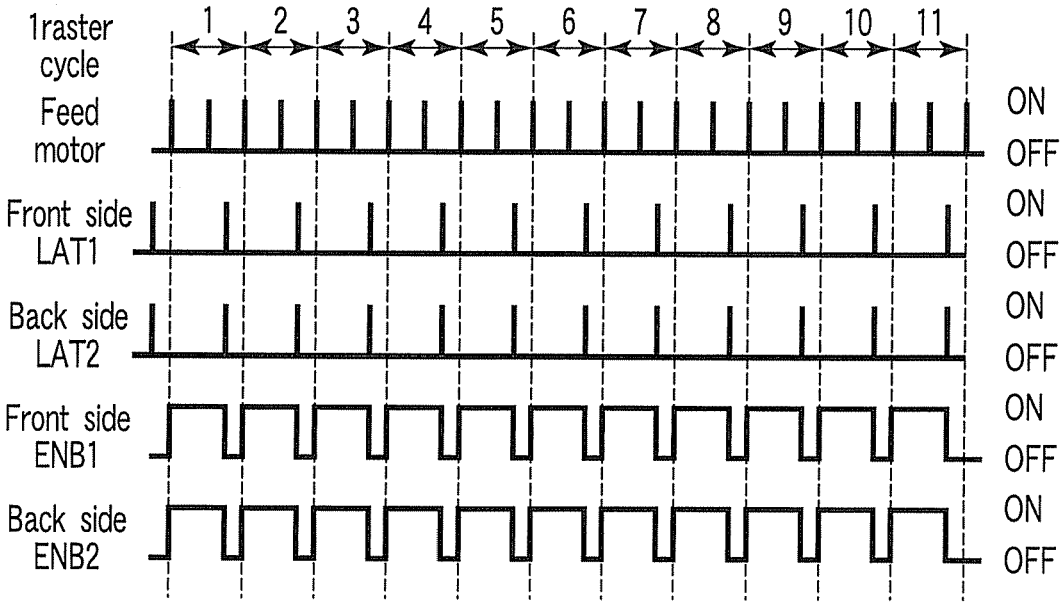
FIG. 7 is a view showing an example of timing of main signals obtained in the case where the synchronous print mode is set as the print mode in the first embodiment.

FIG. 7 is a timing chart of main signals obtained in the case where the synchronous print mode is set. FIG. 7 shows, from above, a cycle (raster cycle) required for printing of one-line data composed of N dots, a drive pulse signal for the feed motor 23, a latch signal LAT1 for the first thermal head 2, a latch signal LAT2 for the second thermal head 4, an enable signal ENB1 for the first thermal head 2, and an enable signal ENB2 for the second thermal head 4.

Also in the case where the synchronous print mode is set, as shown in FIG. 7, the drive pulse signal is output at a ½ cycle of one raster cycle, as in the case where the asynchronous print mode is set. The latch signals LAT1 and LAT2 are output at the same cycle of one raster cycle. However, one raster cycle is set to half the time length of one raster cycle in the asynchronous print mode.

The enable signals ENB1 and ENB2 are output in synchronization with the first half pulse signal of the drive pulse signal. The pulse widths of the enable signals ENB1 and ENB2 are set shorter than the time length of one raster cycle.

As described above, in the case where the synchronous print mode is set, the time during which the enable signal ENB1 is active and time during which the enable signal ENB2 is active correspond to each other.

Accordingly, the two thermal heads 2 and 4 are energized at the same time. However, the current consumed at the energization time does not exceed the specification of the power source circuit 21.

In the case where the synchronous print mode is set, one raster cycle is set to half the time length of one raster cycle in the asynchronous print mode. Accordingly, the thermal paper 1 is fed at a speed double that in the asynchronous print mode, enabling high speed printing.

The present invention is not limited to the above first embodiment.

In the first embodiment, the energization cycles of the first thermal head 2 and second thermal head 4 are shifted from each other by substantially a ½ cycle so that the energization times for the first thermal head 2 and second thermal head 4 do not overlap each other. However, the method that prevents the energization times from being overlapped with each other is not limited to this.

Figure 9:
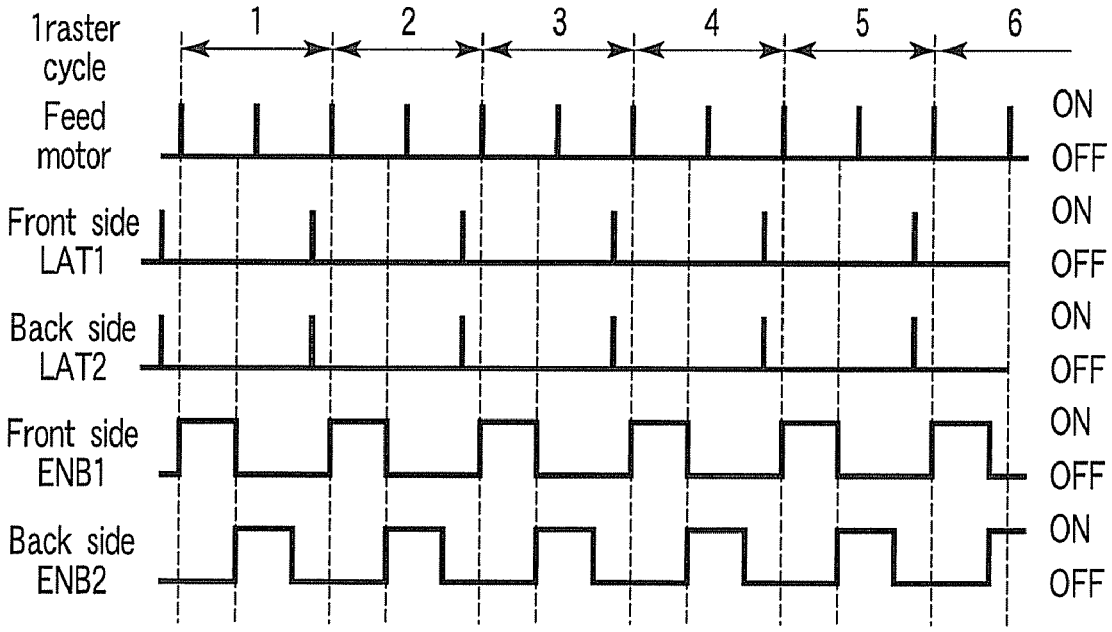
FIG. 9 is another example of timing of main signals obtained in the case where the asynchronous print mode is set as the print mode in the first embodiment.

FIG. 9 is another timing chart of main signals obtained in the case where the asynchronous print mode is set. FIG. 9 shows, from above, a raster cycle, a drive pulse signal for the feed motor 23, a latch signal LAT1, a latch signal LAT2, an enable signal ENB1, and an enable signal ENB2.

Also in this example, the enable signal ENB1 is output in synchronization with the first half pulse signal of the drive pulse signal. On the other hand, the enable signal ENB2 is output in synchronization with the falling edge of the enable signal ENB1. That is, at the time when energization of the first thermal head 2 is ended, energization of the second thermal head 4 is started.

With the above control method, the energization times for the first thermal head 2 and that for the second thermal head 4 do not overlap each other. Therefore, it is possible to reduce the peak value of the required current at the thermal head energization time to a lower value.

In the first embodiment, the energization times for the first and second thermal heads 2 and 4 correspond completely to each other in the case where the synchronous print mode is set. However, even when the energization times for the first and second thermal heads 2 and 4 are allowed to partly overlap each other, high-speed printing can be achieved.

Further, in the first embodiment, the summation of the number of print dots of all the dot data developed in the front side image buffer 52 and the number of print dots of all the dot data developed in the back side image buffer 53 is compared with the threshold value Q to thereby determine the print mode. However, the determination method of the print mode is not limited to this.

For example, the areas of the front side image buffer 52 and back side image buffer 53 are divided into the first half and second half, respectively. Then, the summation of the front side recording pixel count p1 and back side recording pixel count p2 of the first halves is calculated and it is determined whether the summation exceeds the threshold value Q. Similarly, the summation of the front side recording pixel count p1 and back side recording pixel count p2 of the second halves is calculated and it is determined whether the summation exceeds the threshold value Q.

Thus, different print modes may be selected between the first and second halves. In this case, the size into which the areas of the front side image buffer 52 and back side image buffer 53 are divided is not limited to ½.

It is possible to use only the asynchronous mode to perform printing operation in the thermal printer according to the first embodiment. In this case, the processes of steps ST6 through ST9 shown in FIG. 5 can be omitted.

The first embodiment is not limited to a thermal printer using the thermal paper 1 having a front side and back side on which the heat sensitive layer is formed respectively. The first embodiment of the present invention can also be applied to a thermal printer adopting a mechanism for feeding an ink ribbon between the thermal heads 2 and 4 and paper in order for the printer to accept a plain paper and the like.

Second Embodiment

Next, a second embodiment of the present invention will be described, in which a character string of the same size and same line space is printed in dot image data on both sides of the thermal paper 1.

The thermal printer 10 according to the second embodiment has the same hardware configuration as that of the thermal printer 10 according to the first embodiment. Accordingly, FIGS. 1 to 4 are common to the first and second embodiments, and descriptions thereof will be omitted here.

Figure 10:
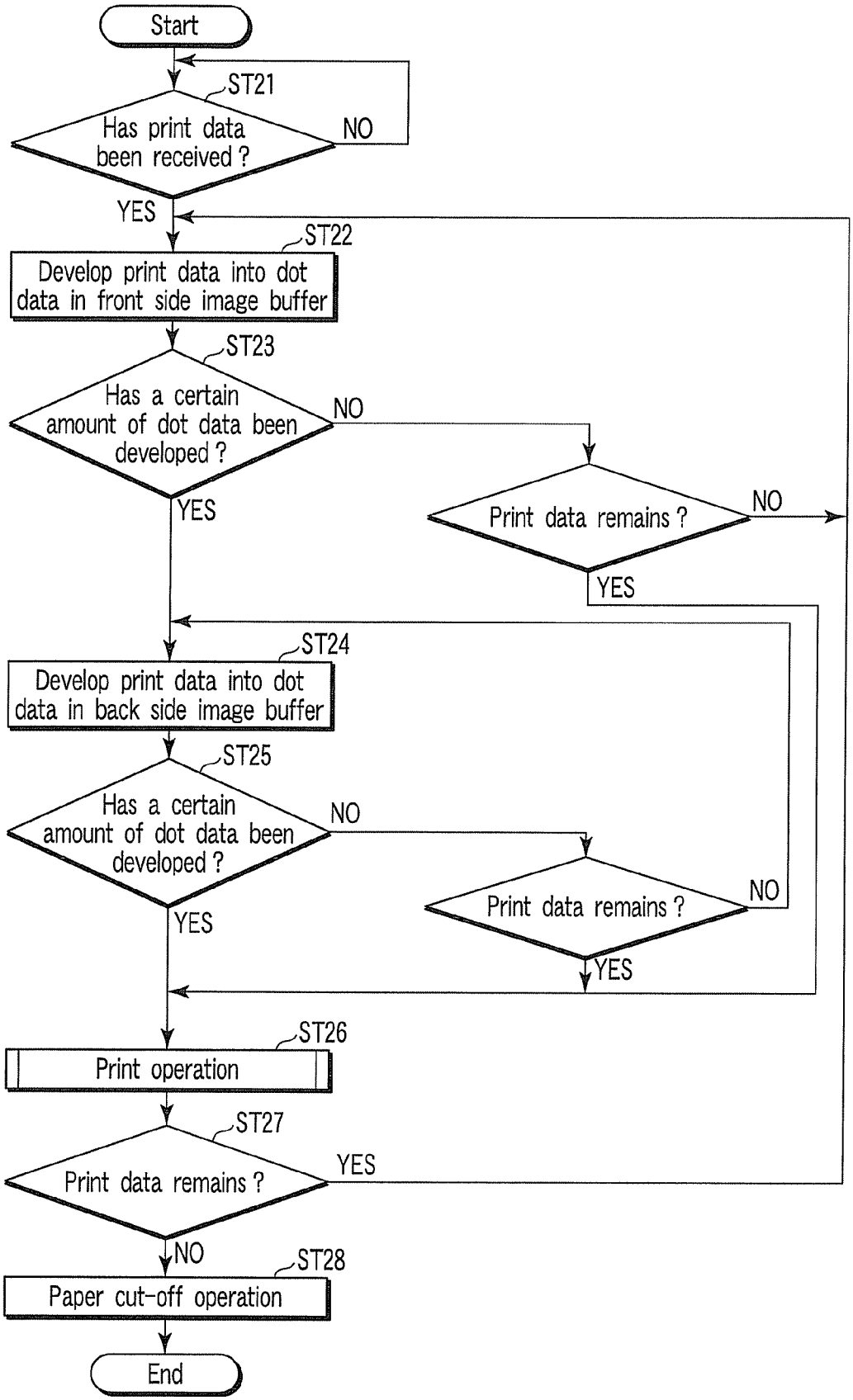
FIG. 10 is a flowchart showing a control procedure of the CPU of the thermal printer in a second embodiment.

FIG. 10 is a flowchart showing a main control procedure of the CPU 11. In the second embodiment, the CPU 11 controls double-sided printing on the thermal paper 1 according to the procedures of steps ST21 through ST28.

The processes of steps ST21 through ST25 are the same as those of steps ST1 through ST5 of the first embodiment, and descriptions thereof will be omitted here.

Figure 11:
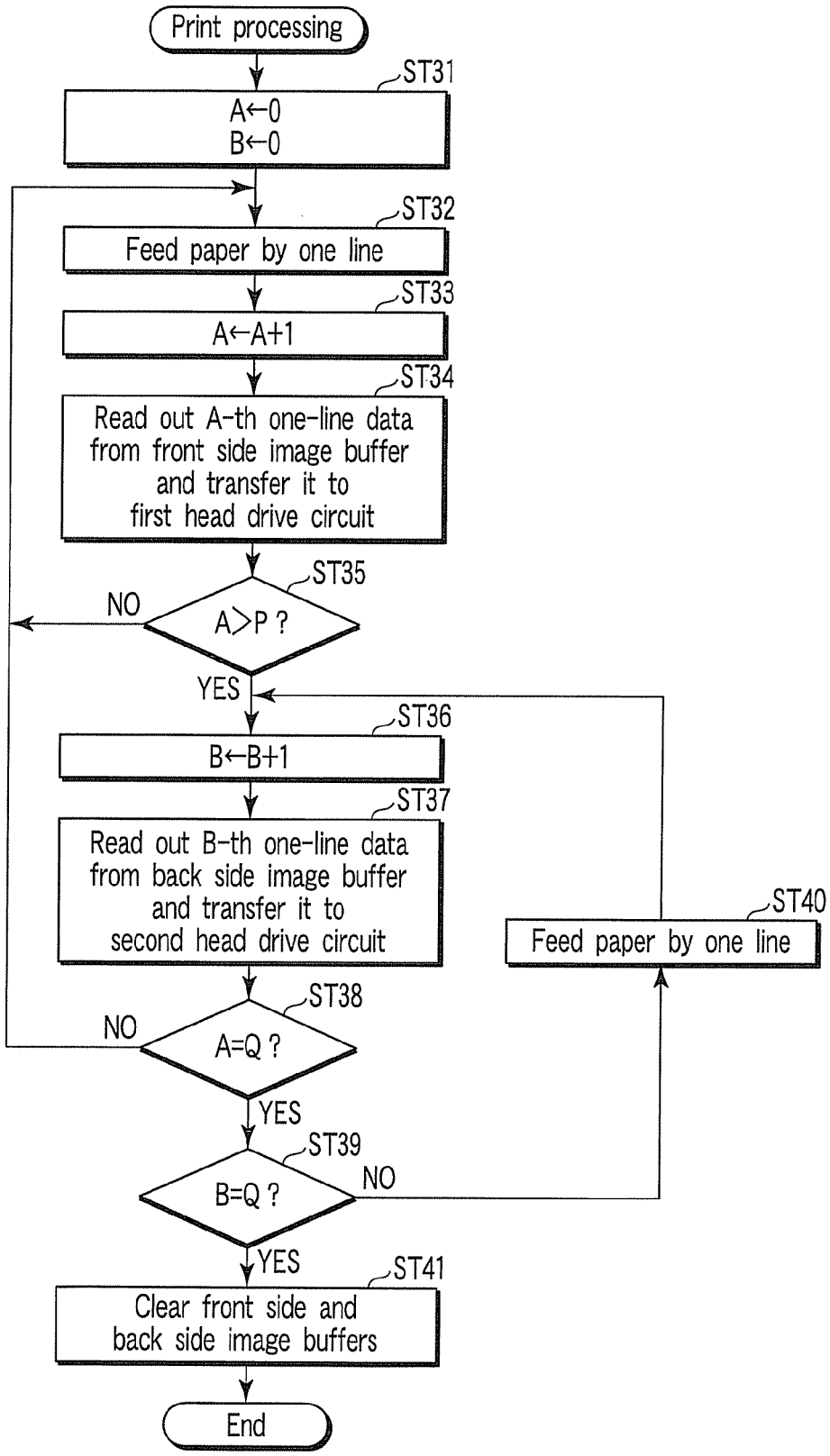
FIG. 11 is a flowchart concretely showing the procedure of the printing processing of FIG. 10.

After a certain amount of dot data has been stored respectively in the front side image buffer 52 and back side image buffer 53, or after all the print data in the reception buffer 51 have been developed into dot data, the CPU 11 advances to step ST26. In step ST26, the CPU 11 executes the printing processing concretely shown in FIG. 11.

In step ST31, the CPU 11 resets a front side line counter A and back side line counter B to "0". The front side line counter A and back side line counter B are allocated in, e.g., the RAM 14.

Then, in step ST32, the CPU 11 drives the feed motor 23 by one step to feed the thermal paper 1 by one line. At this time, the CPU 11 increments the front side line counter A by "1" as step ST33.

Then, in step ST34, the CPU 11 reads out one dot-line data of A-th line from the front side image buffer 52. "A" of the A-th line is a value of the front side line counter A. The CPU 11 then transfers the read out one dot-line data to the first head drive circuit 19.

Then, by the action of the first head drive circuit 19, A-th line one dot-line data is latched by the latch circuit 42 of the first thermal head 2 in synchronization with the latch signal LAT. Then, the heater elements corresponding to the print dots of the one dot-line data latched by the latch circuit 42 are energized while the enable signal ENB is active. As a result, A-th line one dot-line data is printed on the front side 1A of the thermal paper 1.

In step ST35, the CPU 11 determines whether the front side line counter A has exceeded a first setting value P. The first setting value P will be described later. In the case where the front side line counter A has not exceeded the first setting value P, the CPU 11 returns to step ST32.

That is, the CPU 11 repeats the processes of steps ST32 through ST35 until the front side line counter A has exceeded the first setting value P. More specifically, every time the CPU 11 feeds the thermal paper 1 by one line, it repeats the processing of sequentially reading out one dot-line data from the front side image buffer 52 and transferring the one dot-line data to the first head drive circuit 19.

When the front line counter A has exceeded the first setting value P, the CPU 11 increments the back side line counter B by "1" as step ST36.

Then, in step ST37, the CPU 11 reads out one dot-line data of B-th line from the back side image buffer 53. "B" of the B-th line is a value of the back side line counter B. The CPU 11 then transfers the read out one dot-line data to the second head drive circuit 20.

Then, by the action of the second head drive circuit 20, B-th line one dot-line data is latched by the latch circuit 42 of the second thermal head 4 in synchronization with the latch signal LAT. Then, the heater elements corresponding to the print dots of the one dot-line data latched by the latch circuit 42 are energized while the enable signal ENB is active. As a result, B-th line one dot-line data is printed on the back side 1B of the thermal paper 1.

In step ST38, the CPU 11 determines whether the front side line counter A has reached a second setting value Q which is larger than the first setting value P. The second setting value Q will also be described later. In the case where the front side line counter A has not reached the second setting value Q, the CPU 11 returns to step ST32.

That is, the CPU 11 repeats the processes of steps ST32 through ST38 until the front side line counter A has exceeded the second setting value Q. More specifically, every time the CPU 11 feeds the thermal paper 1 by one line, it repeats the processing of sequentially reading out one dot-line data from the front side image buffer 52 and transferring the one dot-line data to the first head drive circuit 19 and processing of reading out one dot-line data from the back side image buffer 53 and transferring the one dot-line data to the second head drive circuit 20.

When the front side line counter A has reached the second setting value Q, the CPU 11 determines whether the back side line counter B has reached the second setting value Q as step ST39. In the case where the back side line counter B has not reached the second setting value Q, the CPU 11 feeds the thermal paper 1 by one line as step ST40 and returns to step ST35.

That is, the CPU 11 repeats the processes of steps ST36 through ST40 until the back side line counter B has exceeded the second setting value Q. More specifically, every time the CPU 11 feeds the thermal paper 1 by one line, it repeats the processing of sequentially reading out one dot-line data from the back side image buffer 53 and transferring the one dot-line data to the second head drive circuit 20.

When the back side line counter B has reached the second setting value Q, the CPU 11 clears the front side image buffer 52 and back side image buffer 53 as step ST41. Then, the current printing operation is completed.

After the completion of the printing operation, the CPU 11 determines whether there remains any print data in the reception buffer 51 as step ST27. In the case where there remains any print data, the CPU 11 executes the processes of steps ST22 through ST27 once again. In the case where there remains no print data, the CPU 11 performs long feeding of the thermal paper 1 as step ST28 and outputs a drive signal to the cutter motor 24. This drive signal causes the cutter motor 24 to activate the cutter mechanism 6, thereby cutting the thermal paper 1. Then, control for the received print data is ended.

Figure 12:
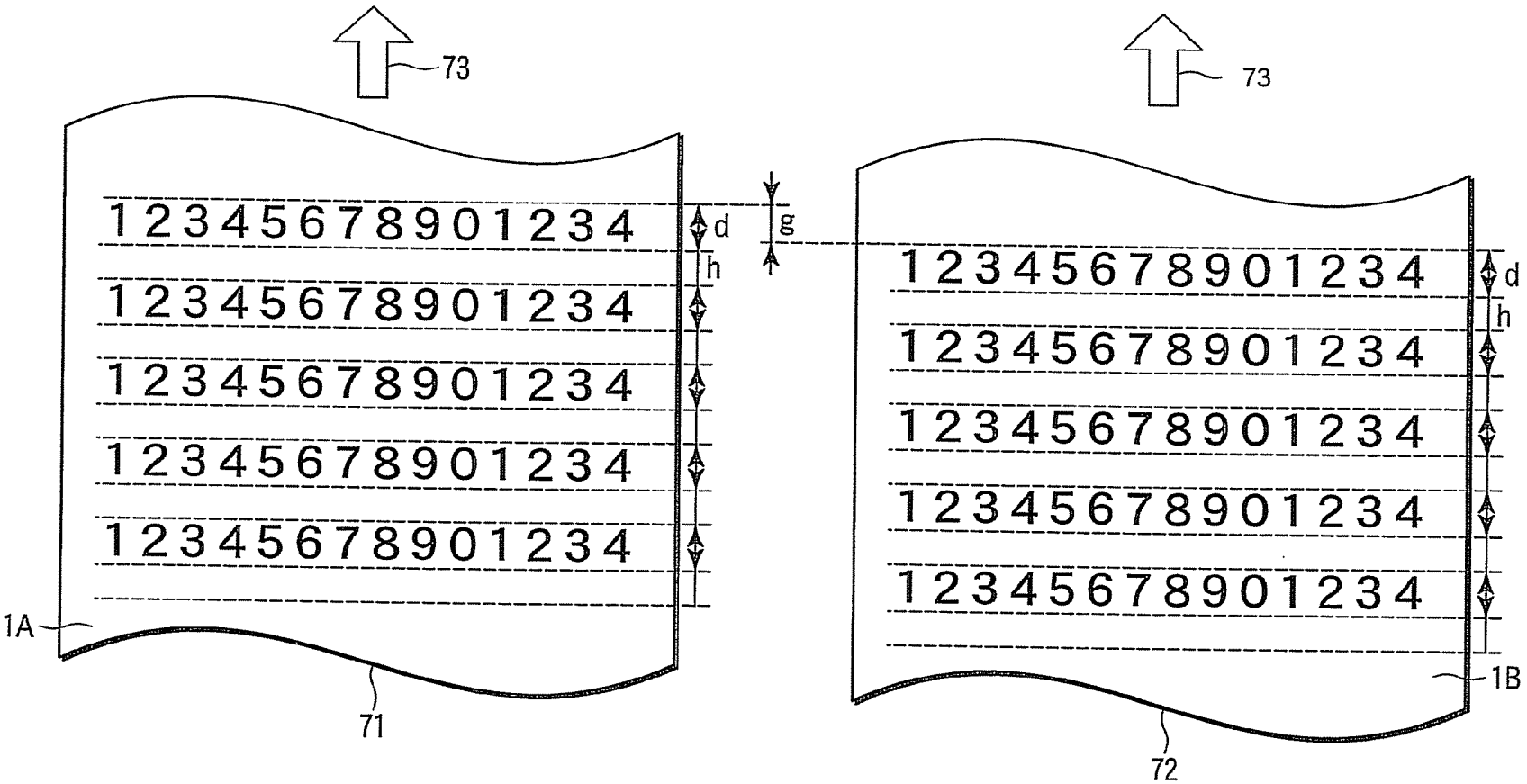
FIG. 12 shows an example of character string data printed on the front and back sides of the thermal paper in the second embodiment.

FIG. 12 shows a printing example in the second embodiment. This example shows a case where a plurality of lines of character string of the same size and same line space (the contents of data to be printed are not necessarily the same between the front and back sides) are printed. In FIG. 12, the left side shows a printing example 71 on the front side 1A of the thermal paper 1, and right side shows a printing example 72 on the back side 1B thereof. The feeding direction of the thermal paper 1 is denoted by an arrow 73.

An interval d denotes the number of lines of dot-line data forming character strings in the direction parallel to the paper feeding direction 73. One dot-line data corresponding to a d line forms a one-line character string.

An interval h denotes the number of lines required for forming a space between upper and lower character strings. One dot-line data (all data are non-print dots) corresponding to an h line forms one line space.

An interval g denotes a gap formed by the number of lines corresponding to ½ of the summation (d+h) of the number d of lines and number h of lines.

The first setting value P is set to a value equal to the number of lines {(d+h)/2} constituting the interval g. The second setting value Q is set to the number of lines of dot image data that can be developed in the front side image buffer 52 and back side image buffer 53. By setting the first and second setting values P and Q as described above, double-sided printing is performed according to the procedure described below.

Firstly, from the 1st line to g-th line, the first thermal head 2 is energized to print dot data of the character string of the 1st line on the front side 1A of the thermal paper 1. At this time, the second thermal head 4 is not energized.

When the printing of the g-th line is performed by the first thermal head 2, the front side line counter A exceeds the first setting value P, with the result that printing operation on the back side 1B by the second thermal head 4 is started. The first thermal head 2 and second thermal head 4 are energized respectively to thereby print dot data of character strings on the front side 1A and back side 1B of the thermal paper 1.

Note that, on the front side 1A, in a line-feed zone having the number h of lines between the character string of one line having the number d of lines and character string of the next line, the first thermal head 2 is not energized. Similarly, on the back side 1B, in a line-feed zone having the number h of lines between the character string of one line having the number d of lines and character string of the next line, the second thermal head 4 is not energized.

Figure 13:
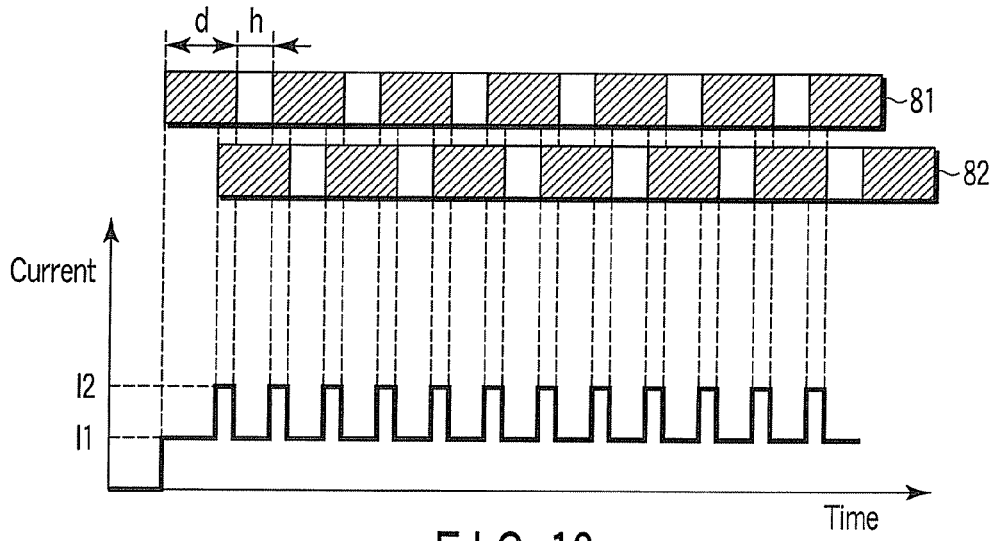
FIG. 13 is a view showing a relationship between the peak value of an energization current applied to the first and second thermal heads and application time thereof in the second embodiment.

FIG. 13 shows a relationship between the peak value (vertical axis) of an energization current applied to the first and second thermal heads 2 and 4 and application time (horizontal axis) thereof in the second embodiment. Further, as a reference, FIG. 14 shows a relationship between the peak value of an energization current and application time thereof in the case where one thermal head is energized, and FIG. 15 shows a relationship between the peak value of an energization current and application time thereof in the case where two thermal heads are simultaneously energized.

Figure 14:
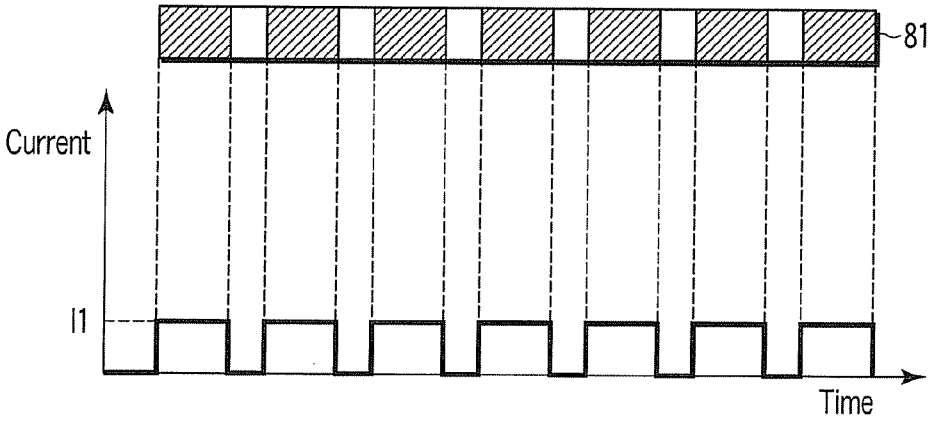
FIG. 14 is a view showing a relationship between the peak value of an energization current and application time thereof in the case where one thermal head is energized in the second embodiment.
Figure 15:
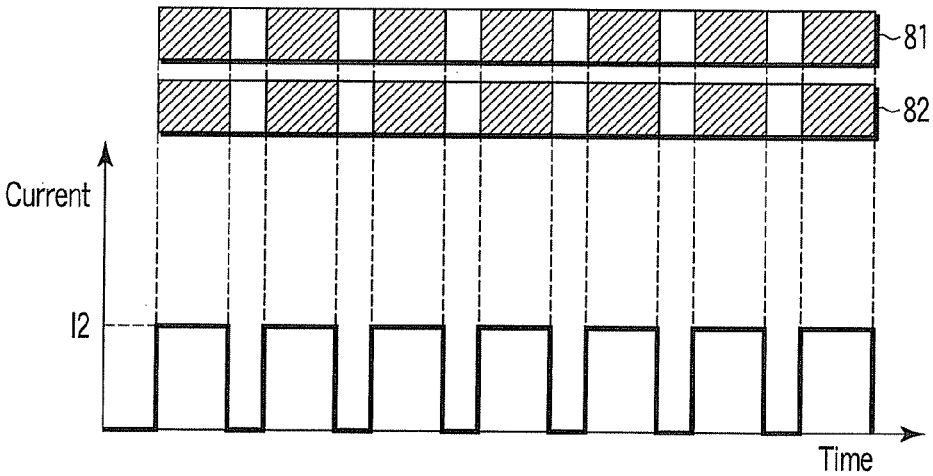
FIG. 15 is a view showing a relationship between the peak value of an energization current and application time thereof in the case where two thermal heads are simultaneously energized in the second embodiment.

FIGS. 13 to 15, reference numeral 81 denotes dot image data printed on the front side 1A by the first thermal head 2. A hatched part denotes character string data, and non-hatched part denotes a space between lines. Reference numeral 82 denotes dot image data printed on the back side 1B by the second thermal head 4. A hatched part denotes character string data, and non-hatched part denotes a space between lines.

As is clear from FIG. 13, in the second embodiment, the time period during which the peak value of the energization current is increased up to I2 is shorter than the energization time required for printing of the character string of one-line by the time required for forming a space between lines. Accordingly, the peak value of the energization current can be reduced down to I1 which is the same level as in the case of the one-side printing in most of the time period.

In the case where the two thermal heads 2 and 4 are used to perform printing on both sides of the paper, the time period during which the peak value of the energization current is increased up to I2 which is equal to the energization time required for printing of the character string of one-line as shown in FIG. 15, which requires a large capacity power source. Therefore, it becomes difficult to achieve a reduction in price and size of the apparatus. According to the second embodiment, such a problem can be solved.

The present invention is not limited to the above-described second embodiment.

In the second embodiment, when the number of print dot-lines has reached the number g of lines after the start of printing of the character string by the first thermal head 2, printing of the character string by the second thermal head 4 is started. However, the method of adjusting the print start timing is not limited to this.

For example, control may be made such that printing of the character string is first started by the second thermal head 4 and, when the number of print dot-lines has reached the number g of lines, printing of the character string is started by the first thermal head 2.

Further, control may be made such that the number of print dot-lines is counted after the start of printing of the character string by one of the thermal heads and, when the number of print dot-lines has reached the number h of dot-lines required for forming a space between lines, printing of the character string is started by the other thermal head. That is, the first setting value P may be set equal to the number h of dot-lines required for forming a space between lines.

Figure 16:
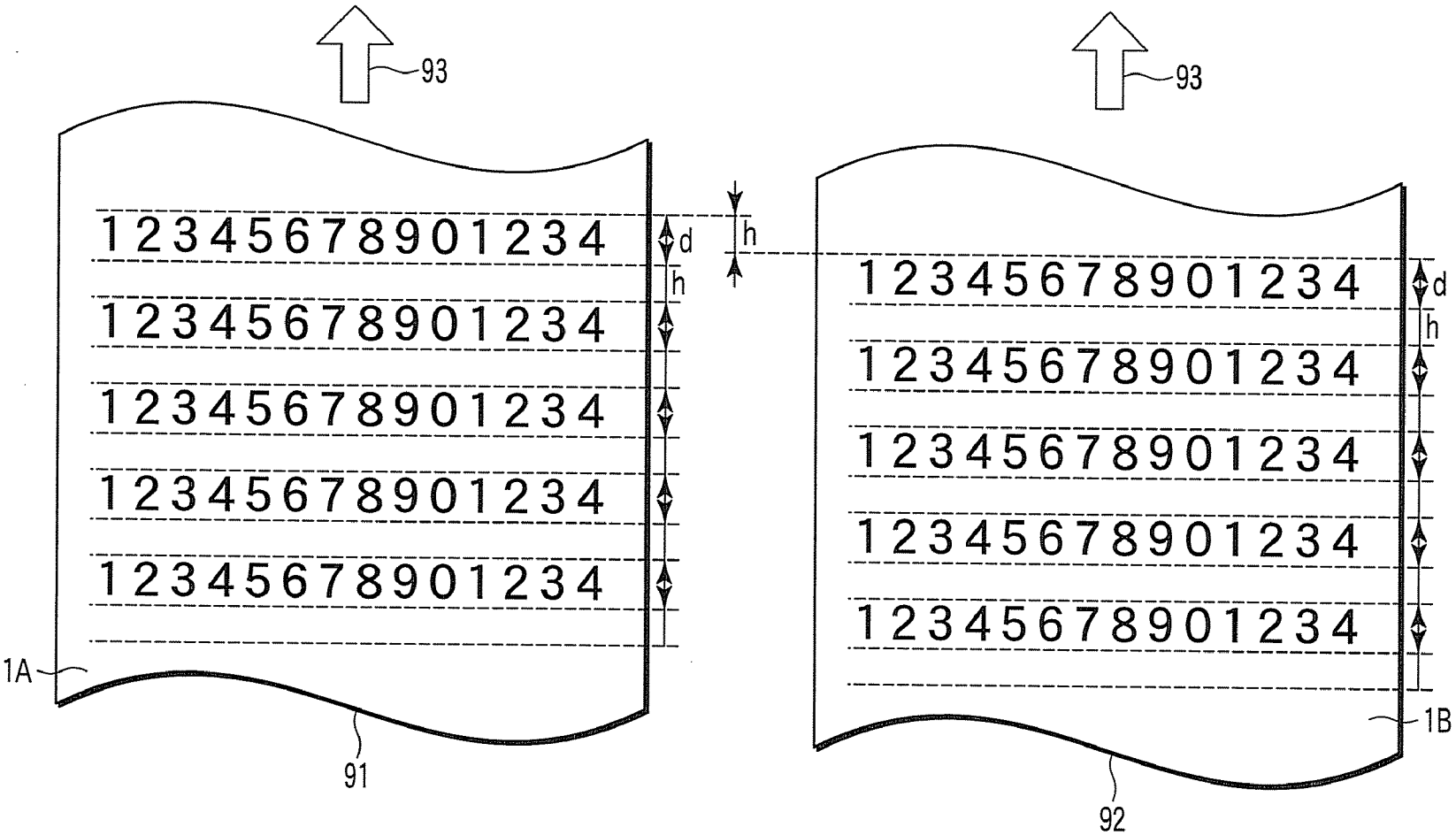
FIG. 16 is a view schematically showing another example of character string data printed on the front and back sides of the thermal paper in the second embodiment.

FIG. 16 shows a printing example in this case. This example also shows a case where a plurality of lines of character string of the same size and same line space are printed. In FIG. 16, the left side shows a printing example 91 on the front side 1A of the thermal paper 1, and right side shows a printing example 92 on the back side 1B thereof. The feeding direction of the thermal paper 1 is denoted by an arrow 93.

Firstly, from 1st line to h-th line, the first thermal head 2 is energized to print dot data of character string of the 1st line on the front side 1A of the thermal paper 1. At this time, the second thermal head 4 is not energized.

When the printing of the h-th line is performed by the first thermal head 2, the front side line counter A exceeds the first setting value P, with the result that printing operation on the back side 1B by the second thermal head 4 is started. The first thermal head 2 and second thermal head 4 are energized respectively to thereby print dot data of character string on the front side 1A and back side 1B of the thermal paper 1.

Note that, on the front side 1A, in a line-feed zone having the number h of lines between the character string of one line having the number d of lines and character string of the next line, the first thermal head 2 is not energized. Similarly, on the back side 1B, in a line-feed zone having the number h of lines between the character string of one line having the number d of lines and character string of the next line, the second thermal head 4 is not energized. Therefore, this case can obtain the same advantage as the second embodiment.

The second embodiment is also not limited to a thermal printer using the thermal paper 1 having a front side and back side on which the heat sensitive layer is formed respectively. The second embodiment of the present invention can also be applied to a thermal printer accepting a plain paper and the like.

In the second embodiment, when one dot-line data is transferred respectively to the first head drive circuit 19 and second head drive circuit 20, the first thermal head 2 and second thermal head 4 are energized at the same time. Accordingly, the peak value of energy (current) consumption becomes large.

Thus, it is preferable that, as in the case of the first embodiment, the energization cycles of the thermal heads 2 and 4 be controlled such that the energization times required for printing of one dot-line data do not overlap between the first and second thermal heads 2 and 4.

This prevents the two thermal heads 2 and 4 from being simultaneously energized, thereby reducing the peak value of the required current at the same level as in the case of the one-side thermal printer.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal printer comprising:

a first thermal head which is so provided as to be brought into contact with one side of a paper and energizes a plurality of heater elements to print dot image data on the one side of the paper;

a second thermal head which is so provided as to be brought into contact with the other side of the paper and energizes a plurality of heater elements to print dot image data on the other side of the paper; and a controller configured to control the energization cycles of the first and second thermal heads such that the energization time required for the first thermal head to print one dot-line data and energization time required for the second thermal head to print one dot-line data do not overlap each other, in the case where a character string of the same size and same line space is printed in dot image data on both sides of the thermal paper using the first and second thermal heads, the controller shifts the print start timing of the character string by the first thermal head and print start timing of the character string by the second thermal head from each other at least by the time required for forming the space between lines.

2. The thermal printer according to claim 1, the controller counts the number of print dot-lines from the start of printing of the character string by one of the first and second thermal heads and, when the number of lines has reached substantially ½ of the summation of the number of dot-lines required for forming the character string and space between lines, starts printing of the character string by the other thermal head.

3. The thermal printer according to claim 1, the controller counts the number of print dot-lines from the start of printing of the character string by one of the first and second thermal heads and, when the number of lines has reached the number of dot-lines required for forming the space between lines, starts printing of the character string by the other thermal head.

4. A thermal head drive control method of a thermal printer comprising:

providing a first thermal head to be brought into contact with one side of a paper and to energize a plurality of heater elements to print on the one side of the paper;

providing a second thermal head to be brought into contact with the other side of the paper and to energize a plurality of heater elements to print on the other side of the paper;

providing a controller to control energization cycles of the first and second thermal heads such that the energization time required for the first thermal head to print one dot-line data and energization time required for the second thermal head to print one dot-line data do not overlap each other; and operating the controller such that, in the case where a character string of the same size and same line space is printed in dot image data on both sides of the thermal paper using the first and second thermal heads, the print start timing of the character string by the first thermal head and print start timing of the character string by the second thermal head are shifted from each other at least by the time required for forming the space between lines.

5. The thermal head drive control method according to claim 4, comprising:

counting the number of print dot-lines from the start of printing of the character string by one of the first and second thermal heads and, when the number of lines has reached ½ of the summation of the number of dot-lines required for forming the character string and space between lines, starting printing of the character string by the other thermal head.

6. The thermal head drive control method according to claim 4, comprising:

counting the number of print dot-lines from the start of printing of the character string by one of the first and second thermal heads and, when the number of lines has reached the number of dot-lines required for forming the space between lines, starting printing of the character string by the other thermal head.

* * * * *